US007847487B2

(12) United States Patent
Kato

(10) Patent No.: US 7,847,487 B2
(45) Date of Patent: Dec. 7, 2010

(54) LED LIGHTING DEVICE

(75) Inventor: Akira Kato, Takatsuki (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 153 days.

(21) Appl. No.: 12/049,630

(22) Filed: Mar. 17, 2008

(65) Prior Publication Data

US 2008/0157689 A1 Jul. 3, 2008

Related U.S. Application Data

(63) Continuation of application No. PCT/JP2006/317627, filed on Sep. 6, 2006.

(30) Foreign Application Priority Data

Sep. 20, 2005 (JP) ..... 2005-272487

(51) Int. Cl.
*H05B 37/00* (2006.01)

(52) U.S. Cl. ..... 315/192; 315/185 S; 315/191

(58) Field of Classification Search ..... 315/185 R, 315/185 S, 191–192; 362/800, 812
See application file for complete search history.

(56) References Cited

U.S. PATENT DOCUMENTS 5,739,639 A * 4/1998 Johnson ..... 315/86
6,069,452 A * 5/2000 Rossner ..... 315/192
6,084,357 A * 7/2000 Janning ..... 315/122
6,194,839 B1 2/2001 Chang
6,288,497 B1 * 9/2001 Chang et al. ..... 315/185 R
6,642,666 B1 * 11/2003 St-Germain ..... 315/185 S
6,853,150 B2 * 2/2005 Clauberg et al. ..... 315/185 R
7,049,757 B2 5/2006 Foust et al.
7,420,332 B2 * 9/2008 Kato ..... 315/185 S (Continued)

FOREIGN PATENT DOCUMENTS

JP 11-068161 3/1999

(Continued)

OTHER PUBLICATIONS

International Search Report with English-language translation issued Oct. 17, 2006 Written Opinion.

*Primary Examiner*—Douglas W Owens
*Assistant Examiner*—Tung X Le
(74) *Attorney, Agent, or Firm*—Keating & Bennett, LLP

(57) ABSTRACT

Two LED arrays are connected in parallel, and the both ends of the parallel connection are connected to an alternating-current power supply AC. In each of the LED arrays, a capacitor and three LED blocks (the total of four components) are connected in series. In each of the LED blocks, two LEDs are connected in opposite directions. Connection points between components included in one of the two LED arrays are individually connected to connection points between components included in the other one of the two LED arrays via varistors. Even in the event that a disconnection failure occurs at any one of the LEDs, a path of a current via one of the varistors is formed for another one of the LEDs which is connected in series to the LED at which the disconnection failure has occurred. This can prevent the other LEDs from being turned off. Even in the event that a short-circuit failure occurs at any one of the varistors, the normal lighting operations of the LEDs can be maintained unless the LEDs have defects.

5 Claims, 2 Drawing Sheets

U.S. PATENT DOCUMENTS

| | | | | |
|---|---|---|---|---|
| 2003/0122502 | A1 | 7/2003 | Clauberg et al. | |
| 2004/0042205 | A1* | 3/2004 | Tanabe et al. | 362/189 |
| 2005/0174065 | A1* | 8/2005 | Janning | 315/185 S |
| 2007/0080652 | A1* | 4/2007 | Elferich et al. | 315/291 |

FOREIGN PATENT DOCUMENTS

| | | |
|---|---|---|
| JP | 2003-513453 | 4/2003 |
| JP | 2003-529190 | 9/2003 |
| JP | 2004-134359 | 4/2004 |
| JP | 2005-513819 | 5/2005 |

* cited by examiner

FIG. 3
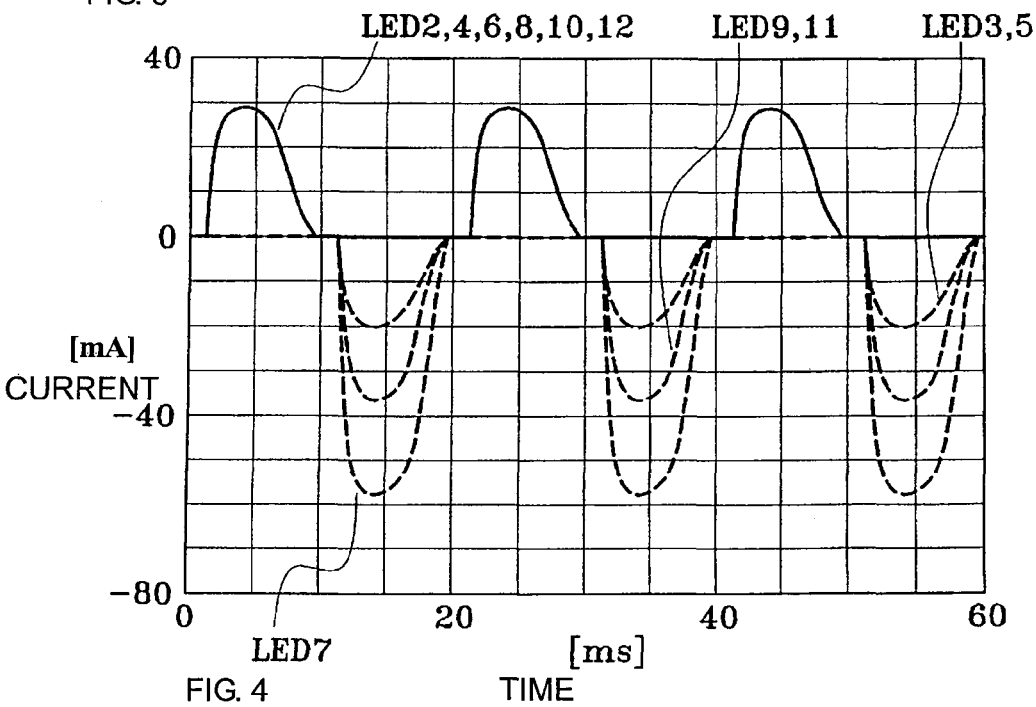
FIG. 4
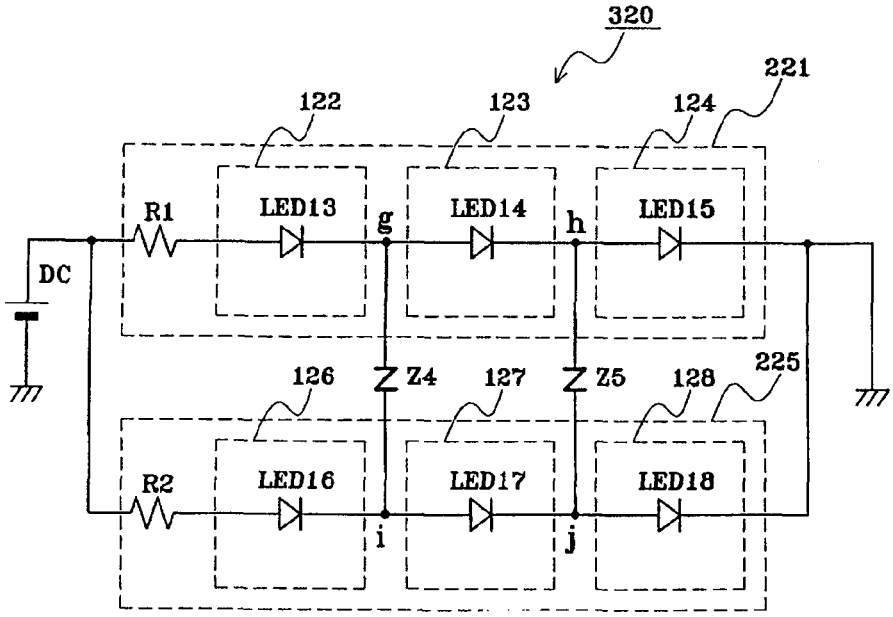
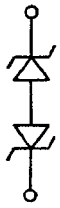
FIG. 5(a)
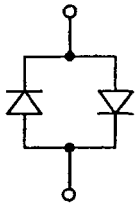
FIG. 5(b)

LED LIGHTING DEVICE

CROSS-REFERENCE TO RELATED APPLICATIONS

This is a continuation under 35 U.S.C. §111(a) of PCT/JP2006/317627 filed Sep. 6, 2006, and claims priority of JP2005-272487 filed Sep. 20, 2005, incorporated by reference.

BACKGROUND

1. Technical Field

The present invention relates to an LED lighting device and more particularly to a device including plural LED arrays, for being driven by power supplied from a DC or AC power supply.

2. Background Art

LEDs (light-emitting diodes) are known to have a high degree of luminous efficiency. Various products using high-intensity white light-emitting diodes have been commercialized as energy-saving products, and have become cheaper. Currently, the use of LEDs for lighting devices is also being considered.

Patent Document 1 discloses an lighting device for which LEDs are used. The LED lighting device disclosed in Patent Document 1 is driven by applying a DC voltage to the series-parallel connection of a plurality of LEDs. In this LED lighting device, each of these LEDs is connected in parallel to an element having a breakdown voltage such as a varistor or a Zener diode. Accordingly, even in the event that a disconnection failure occurs at any one of the LEDs and the LED is turned off, the other LEDs can be prevented from being turned off by transmitting a current to them using an alternative path. That is, the varistors or Zener diodes provide fault tolerance of the LEDs.

Patent Document 1: Japanese Unexamined Patent Application Publication No. 2004-134359

SUMMARY

However, in the LED lighting device disclosed in Patent Document 1, in the event that a short-circuit failure occurs at one of the varistors or the Zener diodes, one of the LEDs which is connected thereto is turned off in spite of the fact that the LED itself has no trouble. Thus, improved fault tolerance of the LEDs would be desirable.

The present embodiments provide an LED lighting device in which the short-circuit failure of an element providing fault tolerance of an LED does not affect the lighting of the LED.

An LED lighting device according to the disclosed embodiments includes a plurality of LED arrays connected in parallel, each having the same configuration, in which a plurality of components including at least two LED blocks are connected in series. Connection points having the same positions along the length of two different LED arrays are connected via an element having a bidirectional breakdown voltage. Each of the connection points connects two of the plurality of components, at least one of which is one of the LED blocks.

The LED blocks each may include a single LED, and the LEDs of all of the LED blocks may be arranged in the same direction. Alternatively, at least one of the plurality of components included in each of the plurality of LED arrays may be a capacitor. The LED blocks each may have two LEDs connected in parallel in opposite directions.

It is desirable that a breakdown voltage of the element having a bidirectional breakdown voltage be substantially the same as a forward voltage drop of each of the LED blocks.

Furthermore, the element having a bidirectional breakdown voltage may be a varistor. Alternatively, the element having a bidirectional breakdown voltage may include two Zener diodes connected in series in opposite directions or two diodes connected in parallel in opposite directions.

In an LED lighting device according to the disclosed embodiments, even in the event that one of a plurality of LEDs is disconnected or short-circuited and is then turned off, this does not adversely affect the lighting of each of the other LEDs and the other LEDs can be prevented from being turned off. Furthermore, the number of elements providing fault tolerance can be reduced, and the LED lighting device can be brought down in size and cost. Even in the event that an element providing fault tolerance is short-circuited, the LEDs can be prevented from being turned off.

Other features and advantages of the LED lighting device will become apparent from the following description of embodiments thereof which refers to the accompanying drawings.

BRIEF DESCRIPTION OF THE DRAWINGS

FIG. 3 is a characteristic diagram illustrating a time waveform of a current flowing through each of the LEDs when an LED 1 included in the LED lighting device illustrated in FIG. 1 is disconnected.

FIG. 4 is a circuit diagram illustrating another embodiment of an LED lighting device.

FIGS. 5*a* and 5*b* are diagrams illustrating other examples of elements having a bidirectional breakdown voltage which can be used in an LED lighting device.

DETAILED DESCRIPTION

Reference Numerals

| | |
|---|---|
| 310 and 320 | LED lighting device |
| 211, 215, 221, and 225 | LED array |
| 112, 113, 114, 116, 117, 118, 122, 123, 124, 126, 127, and 128 | LED block |
| LED 1 to LED 18 | LED |
| Z1 to Z5 | varistor |
| C1 and C2 | capacitor |
| AC | alternating-current power supply |
| R1 and R2 | resistor |
| DC | direct-current power supply |

First Embodiment

Figure 1:
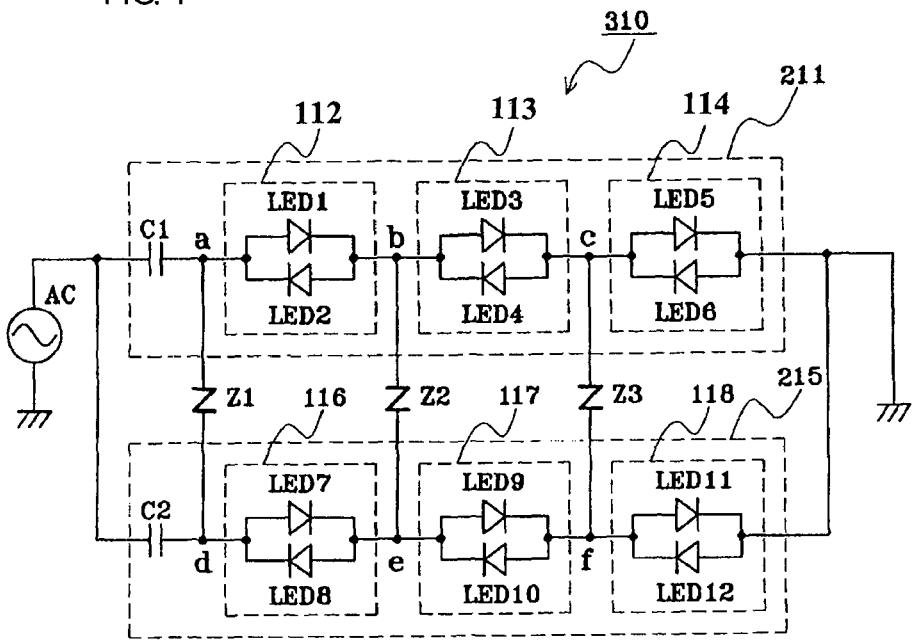
FIG. 1 is a circuit diagram illustrating an embodiment of an LED lighting device.

FIG. 1 is a circuit diagram illustrating an embodiment of an LED lighting device according to the present invention. As illustrated in FIG. 1, an LED lighting device 310 includes two LED arrays each having two terminals, an LED array 211 and an LED array 215. The LED array 211 and the LED array 215 are connected in parallel. Both ends of the parallel connection are connected to an alternating-current power supply AC.

The LED array 211 includes four components that are connected in series between the two terminals, that is, a capacitor C1, a first LED block 112, a second LED block 113, and a third LED block 114. Here, connection points between two of the four components are defined as points a, b, and c. At least one of the two components connected by each of the three connection points is one of the LED blocks. The LED array 215 also includes four components that are connected in series between the two terminals, that is, a capacitor C2, a first LED block 116, a second LED block 117, and a third LED block 118. Here, connection points between two of the four components are defined as points d, e, and f. At least one of the two components connected by each of the three connection points is one of the LED blocks. The capacitors C1 and C2 are nonpolarized capacitors.

In the first LED block 112 in the LED array 211, two LEDs (an LED 1 and an LED 2) are connected in parallel such that they are opposite in direction. The second LED block 113 also includes a parallel connection of an LED 3 and an LED 4. The third LED block 114 also includes a parallel connection of an LED 5 and an LED 6.

The first LED block 116 in the LED array 215 also includes a parallel connection of an LED 7 and an LED 8. The second LED block 117 also includes a parallel connection of an LED 9 and an LED 10. The third LED block 118 also includes a parallel connection of an LED 11 and an LED 12.

The connection point (the point a) between the capacitor C1 and the LED block 112, which are the first and second components, respectively, in the LED array 211, is connected to the connection point (the point d) between the capacitor C2 and the LED block 116, which are the first and second components, respectively, in the LED array 215, via a varistor Z1 that is an element having a bidirectional breakdown voltage. The connection point (the point b) between the LED block 112 and the LED block 113, which are the second and third components, respectively, in the LED array 211, is connected to the connection point (the point e) between the LED block 116 and the LED block 117, which are the second and third components, respectively, in the LED array 215, via a varistor Z2. The connection point (the point c) between the LED block 113 and the LED block 114, which are the third and fourth components, respectively, in the LED array 211, is connected to the connection point (the point f) between the LED block 117 and the LED block 118, which are the third and fourth components, respectively, in the LED array 215, via a varistor Z3. Thus, the connection points having the same order in the LED array 211 and the LED array 215 are connected via the element having a bidirectional breakdown voltage. Each of the connection points connects two components, at least one of which is one of the LED blocks.

The bidirectional breakdown voltage of each of the varistors Z1, Z2, and Z3 is set to a value that is substantially the same as a forward voltage drop of each of the LED blocks, that is, a forward voltage drop of each of the LEDs included in each of the LED blocks in this case.

The operation of the LED lighting device 310 having the above-described configuration will be described below. First, the voltage of the alternating-current power supply AC is directly applied to the LED arrays 211 and 215. The alternating-current power supply AC may be a commercial alternating-current power supply itself. Alternatively, a voltage obtained by stepping down a voltage supplied from the commercial alternating-current power supply using a transformer may be used.

The AC voltage applied to the LED array 211 is applied to the capacitor C1 and the LED blocks 112, 113, and 114. At that time, a large part of the voltage is applied to the capacitor C1 and a voltage of a few volts is applied to the LED blocks 112, 113, and 114. Conversely, the voltage of the alternating-current power supply AC is set such that a voltage of a few volts is applied to the LED blocks 112, 113, and 114, and the capacitance value of the capacitor C1 is set in accordance with the frequency of the alternating-current power supply AC. For example, in the case of the LED lighting device 310, the voltage of a commercial power supply is AC 50 Hz and 100 V (283 Vp-p), and the number of LEDs connected in series is three. If the lighting condition of each of the LEDs is 3.6 V and 500 mA, the total of voltages applied to the three LED blocks is 10.8 V Accordingly, a voltage drop required for the capacitor C1 is 272.2 V, that is, 544.4Ω expressed in terms of resistance. The capacitance of the capacitor C1 is therefore set to 5.8 μF. The LED array 215 has the same configuration as that of the LED array 211.

Figure 2:
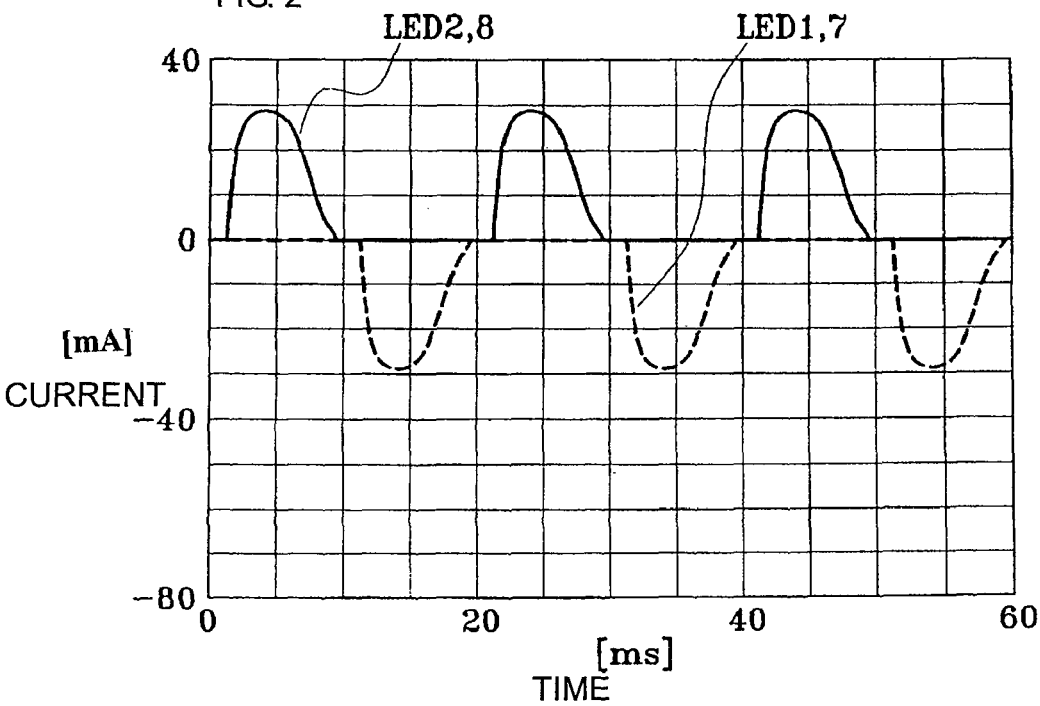
FIG. 2 is a characteristic diagram illustrating a time waveform of a current flowing through each of LEDs included in the LED lighting device illustrated in FIG. 1.

When an AC voltage is applied to the LED lighting device 310, a predetermined AC voltage is applied to the LED block 112 included in the LED array 211. During a period in which the AC voltage is a forward voltage for the LED 1, a current flows through the LED 1 and the LED 1 is turned on. Conversely, during a period in which the AC voltage is a forward voltage for the LED 2, a current flows through the LED 2 and the LED 2 is turned on. A current similarly flows through the LED blocks 113 and 114 included in the LED array 211. During this period, in each of the LED blocks 113 and 114, one of the LEDs through which a forward current flows is turned on. A current similarly flows through the LED blocks 116, 117, and 118 included in the LED array 215. During this period, in each of the LED blocks 116, 117, and 118, one of the LEDs through which a forward current flows is turned on. FIG. 2 is a characteristic diagram illustrating a time waveform of a current flowing through each of the LEDs. In FIG. 2, a forward direction for the LED 2 is represented as a positive direction.

Next, the connection portions between the LED arrays will be considered. If all of the LEDs have substantially the same characteristic and work properly, the potential of the point a included in the LED array 211 is substantially the same as that of the point d included in the LED array 215. Accordingly, a voltage across the varistor Z1 connected between them becomes substantially zero volts so that a breakdown current does not flow through the varistor Z1. The potential of the point b included in the LED array 211 is substantially the same as that of the point e included in the LED array 215. Accordingly, a voltage across the varistor Z2 connected between them becomes substantially zero volts so that a breakdown current does not flow through the varistor Z2. The potential of the point c included in the LED array 211 is substantially the same as that of the point f included in the LED array 215. Accordingly, a voltage across the varistor Z3 connected between them becomes substantially zero volts so that a breakdown current does not flow through the varistor Z3. That is, a current does not flow between the two LED arrays via the varistors. This situation is the same as that obtained when the varistors Z1, Z2, and Z3 are not included.

Next, a case in which a disconnection failure occurs at the LED 1 included in the first LED block 112 will be considered. In this case, during a period in which a forward voltage is applied to the LED 1, a current does not flow through the first LED block 112. This leads to a disruption of a balance between the potentials of the components included in the two LED arrays. More specifically, the potential of the point a included in the LED array 211 becomes higher than that of the point d included in the LED array 215, and a current flows from the point a to the point d via the varistor Z1. Furthermore, the potential of the point b included in the LED array 211 becomes lower than that of the point e included in the LED array 215, so that the current flows from the point e to the point b via the varistor Z2. As a result, the current can continue to flow through the capacitor C1, the LED 3, and the LED 5. Thus, the LED 3 and the LED 5 can be prevented from being turned off.

In this case, since the current that should flow through the LED 1 flows through the LED 7, the maximum amplitude of the current flowing through the LED 7 is about twice that of the current flowing through, for example, the LED 2 as illustrated in a characteristic diagram in FIG. 3. A voltage across a series circuit including the LED 9 and the LED 11 becomes larger than that across a series circuit including the LED 3 and the LED 5 by a breakdown voltage of the varistor Z2. Accordingly, the maximum amplitude of a current flowing through the LED 9 and the LED 11 also becomes larger than that flowing through the LED 3 and the LED 5.

In the event that a disconnection failure occurs at the LED 3 included in the LED block 113, during a period in which a forward voltage is applied to the LED 3, the potential of the point b included in the LED array 211 becomes higher than that of the point e included in the LED array 215 and a current flows from the point b to the point e via the varistor Z2. Furthermore, the potential of the point c included in the LED array 211 becomes lower than that of the point f included in the LED array 215 and the current flows from the point f to the point c via the varistor Z3. As a result, the current can also flow through the capacitor C1, the LED 1, and the LED 5. Thus, the LED 1 and the LED 5 can be prevented from being turned off.

Although not illustrated in a drawing, the maximum amplitude of the current flowing through the LED 9 is also about twice that flowing through the other LEDs in this case. The maximum amplitude of the current flowing through the LED 7 and the LED 11 becomes larger than that flowing through the LED 1 and the LED 5.

Furthermore, in the event that a disconnection failure occurs at the LED 5 included in the LED block 114, during a period in which a forward voltage is applied to the LED 5, the potential of the point c included in the LED array 211 becomes higher than that of the point f included in the LED array 215 and a current flows from the point c to the point f via the varistor Z3. As a result, the current can flow through the capacitor C1, the LED 1, and the LED 3 which are included in the LED array 211. Thus, the LED 1 and the LED 3 can be prevented from being turned off.

Although not illustrated in a drawing, the maximum amplitude of the current flowing through the LED 11 is also about twice that of the other LEDs in this case. Furthermore, the maximum amplitude of the current flowing through the LED 7 and the LED 9 becomes larger than that of the current flowing through the LED 1 and the LED 3.

In the event that a disconnection failure occurs at an LED other than the LED 1, the LED 3, and the LED 5, a current path via a varistor is similarly created. This can prevent the LEDs other than the LED at which the disconnection failure has occurred from being turned off.

During a period in which a backward voltage is applied to the LED 1, the LED 3, or the LED 5 at which the disconnection failure has occurred, no operational difference is made irrespective of the presence of the disconnection failure.

Next, a short-circuit failure of an LED will be considered. For example, if the LED 1 included in the LED array 211 is short-circuited, a path of a current via the LED 1 is maintained. Accordingly, a large potential difference which exceeds the breakdown voltage of a varistor between the point a and the point d or between the point b and the point e is not generated. Therefore, a current path via a varistor between the two LED arrays is not generated. In reality, since a voltage drop caused by the LED 1 does not occur, the amount of the current flowing through the LED array 211 is slightly increased and the amount of the voltage drop caused by the capacitor C1 is increased. At that time, the amounts of voltage drop caused by the LED 3 and the LED 5 do not change. Thus, since the path of a current can be maintained, the LEDs other than the LED at which the short-circuit failure has occurred are not turned off.

In the event that a short-circuit failure occurs at another LED, similarly, no current path via a varistor between the two LED arrays is generated.

Finally, a failure of a varistor disposed between the two LED arrays will be considered. In the event that a disconnection failure occurs at one of the varistors, a current path via the varistor between the two LED arrays is not generated. Accordingly, the varistor cannot provide fault tolerance. However, as described previously, during the normal operation of each of the LEDs, no current path via a varistor is formed. Accordingly, even in the event that a disconnection failure occurs at one of the varistors, this does not adversely affect the lighting of the LEDs.

Next, a case in which a short-circuit failure occurs at one of the varistors will be considered. As described previously, during the normal operation of each of the LEDs, a voltage to be applied to each of the varistors disposed between the two LED arrays is substantially zero volts. Accordingly, even in the event that a short-circuit failure occurs at one of the varistors, a current does not flow in the varistor. This does not adversely affect the lighting of each of the LEDs under normal operating conditions of the LEDs.

However, in the event that a short-circuit failure occurs at the LED 1, the varistor Z1, and the varistor Z2, a current that should flow in the LED 7 included in the LED array 215 flows instead in the LED 1, the varistor Z1, and the varistor Z2, which have been short-circuited, and the LED 7 is therefore turned off. In this case, fault tolerance cannot be achieved. Accordingly, such a configuration in which the varistors may have a direct short-circuit does not achieve fault tolerance.

As described previously, in the LED lighting device 310 according to the present embodiment, by disposing the varistors between the LED arrays, even in the event that a disconnection failure or a short-circuit failure occurs at one of the LEDs and the LED is therefore turned off, the other LEDs can be prevented from being turned off. Furthermore, even in the event that a disconnection failure or a short-circuit failure occurs at one of the varistors, a malfunction in which the LEDs are turned off can be prevented unless the LEDs have no trouble. Using the above-described method of arranging varistors, the number of varistors can be reduced as compared with the case in which a varistor is connected in parallel to each LED as described in Patent Document 1. More specifically, if a varistor is connected in parallel to each of the six LED blocks in the circuit illustrated in FIG. 1 using a method described in Patent Document 1, six varistors are required. In the case of the LED lighting device 310, however, only the three varistors are required. Accordingly, miniaturization and cost reduction can be achieved as compared with the configuration described in Patent Document 1.

Second Embodiment

FIG. 4 is a conceptual circuit diagram illustrating another embodiment of an LED lighting device. An LED lighting device 320 illustrated in FIG. 4 includes two LED arrays each having two terminals, an LED array 221 and an LED array 225. The LED array 221 and the LED array 225 are connected in parallel, and both ends of the parallel connection are connected to a direct-current power supply DC.

The LED array 221 includes four components that are connected in series between the two terminals, that is, a resistor R1, a first LED block 122, a second LED block 123, and a third LED block 124. Here, connection points between the LED blocks are defined as points g and h. The LED array 225 also includes four components that are connected in series between the two terminals, that is, a resistor R2, a first LED block 126, a second LED block 127, and a third LED block 128. Here, connection points between the LED blocks are defined as points i and j.

In the LED array 221, the LED block 122, the LED block 123, and the LED block 124 include an LED 13, an LED 14, and an LED 15, respectively. These LEDs are connected in the same direction. In the LED array 225, the LED block 126, the LED block 127, and the LED block 128 include an LED 16, an LED 17, and an LED 18, respectively. These LEDs are connected in the same direction.

A connection point (the point g) between the LED block 122 and the LED block 123, which are included in the LED array 221, and a connection point (the point i) between the LED block 126 and the LED block 127, which are included in the LED array 225, are connected via a varistor Z4. A connection point (the point h) between the LED block 123 and the LED block 124, which are included in the LED array 221, and a connection point (the point j) between the LED block 127 and the LED block 128, which are included in the LED array 225, are also connected via a varistor Z5. Thus, the connection points having the same order in the LED array 221 and the LED array 225 are connected via the element having a bidirectional breakdown voltage. Each of the connection points connects two components, at least one of which is one of the LED blocks.

The bidirectional breakdown voltage of the varistors Z4 and Z5 is almost the same as a forward voltage drop of each of the LED blocks, that is, a forward voltage drop of each of the LEDs in this case.

The operation of the LED lighting device 320 having the above-described configuration will be described below. First, the voltage of the direct-current power supply DC is directly applied to the two LED arrays, the LED array 221 and the LED array 225.

The DC voltage applied to the LED array 221 is applied to the resistor R1 and the LED blocks 122, 123, and 124. If the lighting condition of each of the LEDs is 3.6V and 500 mA, the total of voltages applied to the three LED blocks becomes 10.8 V. The voltage of the direct-current power supply DC is 15 V. The resistor R1 is a ballast resistor used to stabilize a current value. In this embodiment, the resistance of the resistor R1 is set to 8.4Ω such that a voltage drop 15 V-10.8 V=4.2 V is obtained when a current of 500 mA flows therethrough. The LED array 225 has the same configuration as that of the LED array 221.

When an AC voltage is applied to the LED lighting device 320, a predetermined voltage is applied to the LEDs 13, 14, and 15 included in the LED array 221. Consequently, a current flows through the LEDs 13, 14, and 15, so that they are turned on. The current similarly flows through the LEDs 16, 17, and 18 included in the LED array 225, so that they are turned on.

Here, the connection portion between the LED arrays will be considered. If all of the LEDs work properly, the potential of the point g included in the LED array 221 is almost the same as that of the point i included in the LED array 225. Accordingly, a voltage across the varistor Z4 connected between them becomes almost zero volts and a breakdown current does not flow through the varistor Z4. The potential of the point h included in the LED array 221 is almost the same as that of the point j included in the LED array 225. Accordingly, a voltage across the varistor Z5 connected between them becomes almost zero volts and a breakdown current does not flow through the varistor Z5. That is, a current does not flow between the two LED arrays via the varistors. This situation is the same as that obtained when the varistors Z4 and Z5 are not included.

Next, a case in which a disconnection failure occurs at the LED 13 included in the LED block 122 will be considered. In this case, a current does not flow through the resistor R1 and the LED 13. This leads to a disruption of a balance between the potentials of the components included in the two LED arrays. More specifically, the potential of the point g included in the LED array 221 becomes lower than that of the point i included in the LED array 225, and a current flows from the point i to the point g via the varistor Z4. As a result, the current can also flow through the LED 14 and the LED 15 which are included in the LED array 221. Thus, the LED 14 and the LED 15 can be prevented from being turned off. In this case, there is a possibility that the potential of the point h included in the LED array 221 becomes lower than that of the point j included in the LED array 225 and a current flows from the point j to the point h via the varistor Z5. However, if the current starts to flow through the varistor Z4, the potential difference between the point j and the point h becomes small. If the potential difference is equal to or lower than the breakdown voltage of the varistor Z5, the current does not flow through the varistor Z5.

In the event that a disconnection failure occurs at the LED 14 included in the LED block 123, a current does not flow through the LED 14. This leads to a disruption of a balance between the potentials of the components included in the two LED arrays. More specifically, the potential of the point g included in the LED array 221 becomes higher than that of the point i included in the LED array 225, and a current flows from the point g to the point i via the varistor Z4. Furthermore, the potential of the point h included in the LED array 221 becomes lower than that of the point j included in the LED array 225, and a current flows from the point j to the point h via the varistor Z5. As a result, the current can flow through the LED 13 and the LED 15 which are included in the LED array 221. Thus, the LED 13 and the LED 15 can be prevented from being turned off.

Furthermore, in the event that a disconnection failure occurs at the LED 15 included in the LED block 124, a current does not flow through the LED 15. This leads to a disruption of a balance between the potentials of the components included in the two LED arrays. More specifically, the potential of the point h included in the LED array 221 becomes higher than that of the point j included in the LED array 225, and a current flows from the point h to the point j via the varistor Z5. As a result, the current can flow through the LED 13 and the LED 14 which are included in the LED array 221. Thus, the LED 13 and the LED 14 can be prevented from being turned off. In this case, there is a possibility that the potential of the point g included in the LED array 221 becomes higher than that of the point i included in the LED array 225 and a current flows from the point g to the point i via the varistor Z4. However, if the current starts to flow through the varistor Z5, the potential difference between the point g and the point i becomes small. If the potential difference is equal to or lower than the breakdown voltage of the varistor Z4, the current does not flow through the varistor Z4.

In the event that a disconnection failure occurs at an LED other than the LED 13, the LED 14, and the LED 15, a path of a current via a varistor is similarly created. This can prevent the LEDs other than the LED at which the disconnection failure has occurred from being turned off.

Next, a short-circuit failure of an LED will be considered. For example, even in the event that the LED 13 included in the LED array 211 is short-circuited, a current path is maintained via the LED 13. Accordingly, a large potential difference between the point g and the point i or between the point h and the point j which excesses the breakdown voltage of a varistor between them is not generated. Therefore, a current path is not generated via a varistor between the two LED arrays. In reality, since a voltage drop caused by the LED 13 does not occur, the amount of the current flowing through the LED array 211 is slightly increased and the amount of the voltage drop caused by the resistor R1 is increased. At that time, the amounts of voltage drops caused by the LED 14 and the LED 15 do not change. Thus, since the path of a current can be maintained, the LEDs other than the LED at which the short-circuit failure has occurred are not turned off.

In the event that a short-circuit failure occurs at another LED, a path of a current via a varistor between the two LED arrays is not similarly generated.

Finally, a failure of one of the varistors disposed between the two LED arrays will be considered. In the event that a disconnection failure occurs at one of the varistors, a current path via the varistor between the two LED arrays is not generated. Accordingly, the varistor cannot provide fault tolerance. However, as described previously, during the normal operation of each of the LEDs, no current path is formed via one of the varistors. Accordingly, even in the event that a disconnection failure occurs at one of the varistors, this does not adversely affect the lighting of the LEDs.

Next, a case in which a short-circuit failure occurs at one of the varistors will be considered. As described previously, during the normal operation of each of the LEDs, a voltage to be applied to each of the varistors disposed between the two LED arrays becomes substantially zero volts. Accordingly, even in the event that a short-circuit failure occurs at one of the varistors, a current does not flow the varistor. This does not adversely affect the lighting of each of the LEDs under normal operating conditions of the LEDs.

However, in the event that a short-circuit failure occurs at the LED 14, the varistor Z4, and the varistor Z5, a current that should flow in the LED 17 included in the LED array 25 flows instead in the LED 14, the varistor Z4, and the varistor Z5, which have been short-circuited, and the LED 17 is therefore turned off. In this case, fault tolerance cannot be achieved.

As described previously, in the LED lighting device 320, by disposing the varistors between the LED arrays, even in the event that a disconnection failure or a short-circuit failure occurs at one of the LEDs and the LED is therefore turned off, the other LEDs can be prevented from being turned off. Furthermore, in the event that a disconnection failure or a short-circuit failure occurs at one of the varistors, a malfunction in which the LEDs are turned off under the influence of the failure can be prevented unless the LEDs have defects. Using the above-described method of arranging varistors, the number of varistors can be reduced as compared with the case in which a varistor is connected in parallel to each LED as described in Patent Document 1. Accordingly, miniaturization and cost reduction can be achieved.

In the above-described two embodiments, a varistor is used as an element having a bidirectional breakdown voltage. However, another element may be used if the element has a similar function. For example, as illustrated in FIG. 5(*a*), two Zener diodes may be connected in series in opposite directions. In this case, the breakdown voltage $V_Z$ of each of the Zener diodes is the bidirectional breakdown voltage of an element. By changing the breakdown voltage $V_Z$, an element capable of having various bidirectional breakdown voltages can be achieved. As illustrated in FIG. 5(*b*), two diodes may be connected in parallel in opposite directions. In this case, the forward voltage $V_F$ of each of the diodes is the bidirectional breakdown voltage of an element.

Although particular embodiments have been described, many other variations and modifications and other uses will become apparent to those skilled in the art. Therefore, the present invention is not limited by the specific disclosure herein.

What is claimed is:

1. An LED lighting device comprising:

a plurality of LED arrays that are connected in parallel; wherein said plurality of LED arrays all have the same configuration in which a plurality of components including at least two LED blocks are connected in series;

elements having a bidirectional breakdown voltage are connected between pairs of connection points having the same order in two respective LED arrays, each of the connection points connecting two of the plurality of components, at least one of which is one of the LED blocks;

the elements having the bidirectional breakdown voltage are arranged such no current flows through the elements having the bidirectional breakdown voltage when the plurality of LED arrays are operating properly and current flows through the elements having the bidirectional breakdown voltage when a disconnection failure occurs in one of the plurality of LED arrays;

at least one of the plurality of components included in each of the plurality of LED arrays is a capacitor; and each of the LED blocks includes at least two LEDs connected in parallel in opposite directions.

2. The LED lighting device according to claim 1, wherein the elements having the bidirectional breakdown voltage include varistors.

3. The LED lighting device according to claim 1, wherein the elements having the bidirectional breakdown voltage include two Zener diodes connected in series in opposite directions.

4. The LED lighting device according to claim 1, wherein the elements having the bidirectional breakdown voltage include two diodes connected in parallel in opposite directions.

5. The LED lighting device according to claim 1, wherein a breakdown voltage of the elements having the bidirectional breakdown voltage is substantially the same as a forward voltage drop of each of the LED blocks.

* * * * *